US006357192B1

(12) United States Patent
Schlüter

(10) Patent No.: US 6,357,192 B1
(45) Date of Patent: Mar. 19, 2002

(54) BRIDGE DEVICE FOR PROVIDING A TRANSITION BETWEEN TWO BORDERING FLOOR SEGMENTS OF DIFFERENT LEVELS

(75) Inventor: Werner Schlüter, Iserlohn (DE)

(73) Assignee: Schluter-Systems GmbH, Iserlohn (DE)

( * ) Notice: Subject to any disclaimer, the term of this patent is extended or adjusted under 35 U.S.C. 154(b) by 0 days.

(21) Appl. No.: 09/458,292

(22) Filed: Dec. 10, 1999

(30) Foreign Application Priority Data

Dec. 14, 1998 (DE) ..... 298 22 236 U

(51) Int. Cl.[7] ..... E04B 2/00

(52) U.S. Cl. ..... 52/459; 52/287.1; 52/288.1; 52/393; 52/464

(58) Field of Search ..... 52/459, 460, 461, 52/464, 716.3, 288.1, 395, 396.06, 393; 403/122, 267; 49/469, 470, 471

(56) References Cited

U.S. PATENT DOCUMENTS 5,657,598 A * 8/1997 Wilbs et al. ..... 52/287.1

FOREIGN PATENT DOCUMENTS

| | | |
|---|---|---|
| DE | 8680241.4 | 4/1986 |
| DE | 4439963 A1 | 5/1996 |
| EP | 0407928 B1 | 7/1990 |
| FR | 2367886 | 10/1976 |

* cited by examiner

*Primary Examiner*—Carl D. Friedman
*Assistant Examiner*—Pat J. Chavez
(74) *Attorney, Agent, or Firm*—Flanagan & Flanagan; John R. Flanagan; John K. Flanagan

(57) ABSTRACT

A bridge device for providing a transition between two bordering floor segments of different levels includes a securement shank, a terminal shank and a transition shank. The securement shank is positionable under one of the bordering floor segments which are separated by a space. The terminal shank has spaced upper and lower ends and opposite sides extending between the upper and lower ends. The terminal shank is attached at the lower end to the securement shank and is positionable in the space between the floor segments. One side of the terminal shank is disposed adjacent to and faces toward the one floor segment whereas the other side of the terminal shank faces toward the other floor segment. The transition shank at an end is articulated with and pivotally mounted to the terminal shank between the upper and lower ends thereof at the other side there and extend from the other side of the terminal shank toward the other floor segment such that the transition shank is swivelable within an angular range providing a transition between the floor segments of different levels. The terminal shank has an annular recess formed on the other side thereof facing toward the other floor segment and a hinge pin attached to the terminal shank within the annular recess thereon and extending outwardly from the other side of the terminal shank. The transition shank has a hinging seat formed thereon and being complementary in shape to the annular recess and hinge pin of the terminal shank so as to pivotally connect the transition shank to the terminal shank for undergoing swivelable movement relative thereto.

14 Claims, 1 Drawing Sheet

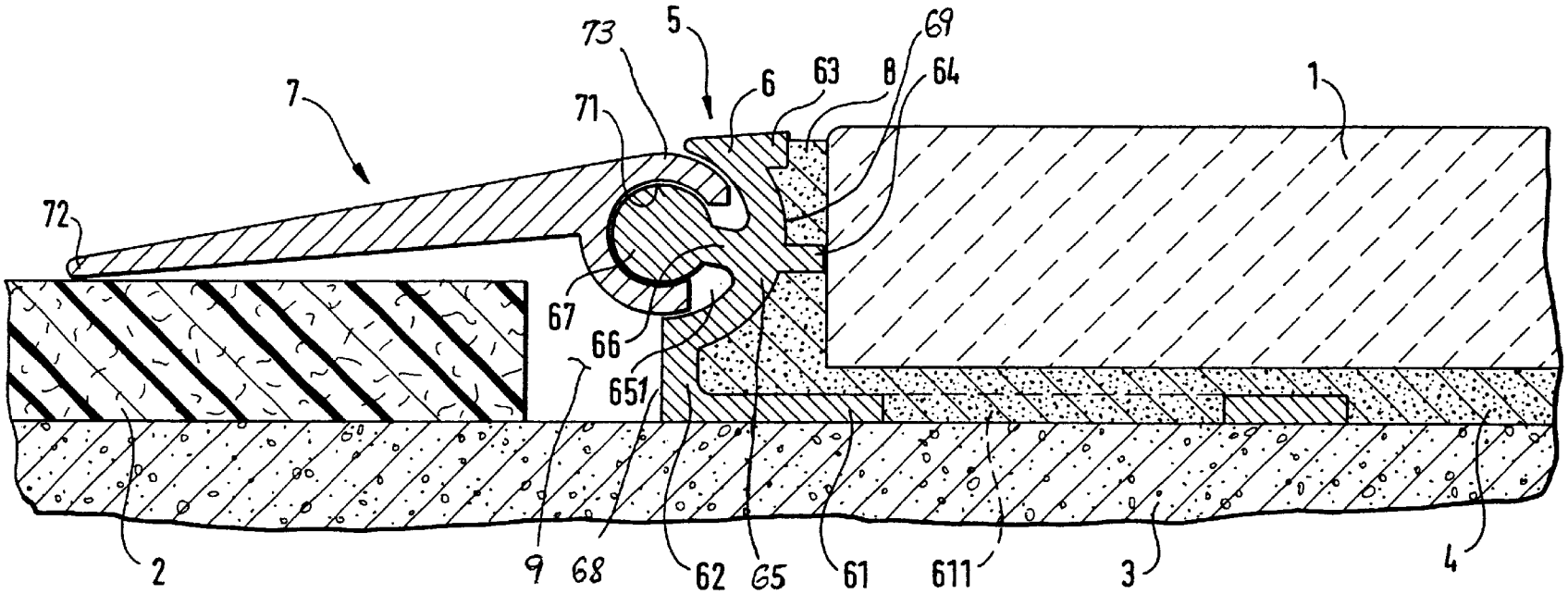
1
4
3
611
61
65
62
68
9
651
66
67
71
73
5
6
63
8
64
69
7
72
2

BRIDGE DEVICE FOR PROVIDING A TRANSITION BETWEEN TWO BORDERING FLOOR SEGMENTS OF DIFFERENT LEVELS

BACKGROUND OF THE INVENTION

1. Field of the Invention

The present invention relates to a bridge device for providing a transition between two bordering floor segments of different levels and, more particularly, is concerned with a bridge device having a securement shank placed under one of the floor segments, a terminal shank integrally attached to the securement shank and disposed adjacent to and so as to protect the bordering edge of the one floor segment, and a transition shank articulated with the terminal shank and extending toward the other of the floor segments so as to provide the transition between the bordering floor segments over a range of different levels.

2.Description of the Prior Art

European patent document No. EP 0 407 928 B1 by the inventor herein discloses a bridge device for providing a transition between two bordering floor segments of different levels. The bridge device is a one-piece structural profile having a securement shank, a terminal shank and an inclined transition shank all of which are integrally connected and fixed relative to one another. The securement shank is rectangular in cross section, has a thickness less than 1.5 mm and is provided with perforations. The terminal shank is formed on an end of the securement shank. The transition shank is formed onto the terminal shank at the end side and, at its outer end, comprises a contact segment for a bordering floor segment. As a rule, such a profile is applied in an adhesion process with its securement shank under one bordering floor segment, such as ceramic tile covering. The free height of the terminal shank, which protects the bordering edges of the ceramic tile covering against damage, corresponds to the height of the ceramic tile covering. Against this structural profile a bordering floor segment, for example a carpet covering, is brought from the other side against the structural profile so as to engage flush with the contact segment of the inclined transition shank. The transition shank forms a stepless gradual transition from the lower floor segment to the higher floor segment. Such profiles must be matched in each instance to the different heights of the bordering floor segments such that a multiplicity of profile sizes are necessary in order to meet the requirements of different applications in practice.

From German patent document No. DE 44 39 963 A1 a device is known for covering open joints between two floor segments of different levels. Here, an angle section is provided in which a securement shank, tapering in cross section toward the outside, is fastened under the floor segments. Onto this securement shank is formed a rectangular support shank on whose upper side a hinge header is realized. Onto this hinge header can be articulated a cover profile rail which, in each instance, rests on one floor segment with its arms directed to both sides, covering the open joint between the two floor segments of different levels. However, since this cover profile rail rests with its two arms on the floor segments of different levels bordering the open joint, the pivoting of the cover profile rail about its articulation relative to the support shank is only possible to a small extent. It is therefore desirable to provide in a cover profile rail having synthetic material nominal bending sites which permit bending the corresponding arms of the cover profile rail such that in the case of the coverage a height compensation is possible to a greater extent.

However, such a coverage device of an open joint cannot be accommodated under ceramic coverings placed on a floor segment using an adhesive process due to the relatively thick securement shanks tapering toward to the outside. The formed-on support shank must be disposed at a sufficient spacing from the bordering edges of the covering in order for the cover profile rail with its hinging seat to be placed thereon. Such a support shank can therefore not assume any protective function for bordering ceramic tile coverings. Moreover, when placing such ceramic tile covering, an overlapping cover profile rail is undesirable which forms a step and which, in addition, disturbs the visual impression of the transition from a higher to a lower floor segment.

SUMMARY OF THE INVENTION

The present invention is directed to a bridge device for providing a transition between two bordering floor segments of different levels. The bridge device comprises a securement shank positionable under one of the floor segments, a terminal shank attached at a lower end on an end of the securement shank and extending upwardly therefrom for protecting the bordering edges of the one floor segment and a transition shank providing a profile flap pivotally held by and articulately linked to the terminal shank and extending away from a side of the terminal shank facing away from the one floor segment and toward the other floor segment such that the transition shank is swivelable so as to be able to bridge different height gradations in a visually appealing manner and thereby accommodate bordering floor segments at different levels.

Due to the articulated linkage of the transition shank on the side of the terminal shank it is possible to swivel and position the transition shank over a relatively wide range so as to be decreasing as well as also increasing relative to the other floor segment. The transition shank can be placed on the other bordering floor segment or can, delimiting the other floor segment at its corresponding edges, be placed in front of the other floor segment on the floor.

A preferred embodiment of the device includes the terminal shank having a cylindrical recess formed on the side thereof facing toward the other floor segment and a hinge pin attached to the terminal shank within the recess and extending outwardly therefrom and the transition shank having a hinging seat of cylindrical shape formed on an end thereof such that the recess on the terminal shank and the hinging seat on the transition shank provide two complementary profiles which are simple in terms of fabrication technology, are articulated with one another in a simple manner and have sufficient strength relative to loading that occurs during use. Furthermore, a top side of the transition shank abuts nearly flush the top side of the terminal shank such that the formation of steps or edges is avoided.

Other features which can be provided in the bridge device, such as when the one floor segment is ceramic tiles, includes its terminal shank having an upper end with an extension directed toward an edge of the one floor segment to be protected by the terminal shank and a spacing element on the terminal shank spaced between the upper and lower ends of the terminal shank and providing an open joint between the bordering edge of the one floor segment and the terminal shank that can be filled with a material, such as grout, to maintain the position of the terminal shank of the bridge device relative to the one floor segment.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWING

In the following detailed description, reference will be made to the attached drawings in which the single FIGURE is a vertical sectional view of a bridge device of the present invention after installation between two bordering floor segments at different levels.

DETAILED DESCRIPTION OF THE INVENTION

Referring to the single FIGURE of the drawing, there is illustrated a bridge device of the present invention, generally designated 5, disposed on a floor 3 for providing a transition between two bordering floor segments 1, 2 of different levels and separated by a space 9. By way of example, the one floor segment 1 can be a ceramic tile covering and the other floor segment 2 can be a different floor covering such as carpeting.

Basically, the bridge device 5 includes a securement shank 61, a terminal shank 6 and a transition shank 7. The securement shank 61 of the bridge device 5 is positioned under the one floor segment 1 within a layer of an adhesive grout 4 applied under the one floor segment 1. The securement shank 61 is provided with one or more perforations 611 that receive portions of the adhesive grout 4.

The terminal shank 6 of the bridge device 5 has spaced lower and upper ends 62, 63 and opposite sides 69, 68 extending between the lower and upper ends 62, 63 and respectively facing in opposite directions toward the one and other floor segments 1, 2.

The terminal shank 6 is attached, and preferably integrally formed, at the lower end 62 to an end of the securement shank 61 and is positionable in the space 9 between the two floor segments 1, 2. The one side 69 of the terminal shank 6 is disposed adjacent to and faces toward the one floor segment 1 whereas the other side 68 of the terminal shank 6 faces toward the other floor segment 2. The upper end 63 of the terminal shank 6 is widened relative to the remainder thereof so as to provide an extension thereon directed toward an upper edge of the one floor segment 1 to be protected by the terminal shank 6. The terminal shank 6 has a spacing element in the form of a flange 64 thereon spaced between the lower and upper ends 62, 63 thereof and extending from the one side 69 thereof so as to position the terminal shank 6 in a spaced relation away from the one floor segment 1 and thereby provide an open joint 8 between the bordering edge of the one floor segment 1 and the terminal shank 6 that is filled with the adhesive grout 4 in order to maintain the spaced position of the terminal shank 6 relative to the one floor segment 1.

The terminal shank 6 further has an arcuate shaped middle portion 65 defining a semi-cylindrical concave shaped annular recess 651 on the other side 68 of the terminal shank 6. The recess 651 faces toward the other floor segment 2. The terminal shank 6 still further has a hinge pin 67 attached by a web 66 to the terminal shank 6 within the annular recess 651 thereon and extending outwardly from the other side 68 thereof.

The transition shank 7 of the bridge device 5 at an end thereof has a hinging seat 71 formed thereon and that is complementary in shape to the annular recess 651 and hinge pin 67 of the terminal shank 6 so as to pivotally connect the transition shank 7 to the terminal shank 6 for undergoing swivelable movement relative thereto. The transition shank 7 thereby constitutes a profile flap that is articulated with and pivotally mounted to the terminal shank 6 between the lower and upper ends 62, 63 thereof at the other side 68 thereof and extends from the other side 68 toward the other floor segment 2 such that the profile flap is swivelable within an angular range downwardly as well as upwardly that can provide a transition between the floor segments 1, 2 of different levels.

The transition shank 7 also has a top portion 73 that nearly abuts and is generally flush with the upper end 63 of the terminal shank 6 so as to avoid formation of a step between the transition shank 7 and the terminal shank 6. The end of the transition shank 7 having the hinging seat 71 is partially received in the recess 651 such that the top portion 73 of the transition shank 7 extends into the upper end 63 of the terminal shank 6 without forming a step.

In the illustrated embodiment, the transition shank 7 has an opposite terminal end 72 that rests on the other floor segment 2. However, in other applications the terminal end 72 could rest on the floor 3 itself. In order to secure the installed condition of the transition segment 7, the articulation connection can be equipped as a clamping connection or its can be equipped with latches.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. Bridge device for providing a transition between two bordering floor segments of different levels, said device comprising:

(a) a securement shank positionable under one of two bordering floor segments separated by a space and of different levels;

(b) a terminal shank having spaced upper and lower ends and being attached at said lower end to said securement shank and extending upwardly therefrom and positionable in the space between the floor segments, said terminal shank also having opposite sides extending between said upper and lower ends thereof, one of said sides disposed adjacent to and facing toward the one floor segment, the other of said sides facing toward the other of the floor segments, said terminal shank further having means for defining a hinge on said other of said sides of said terminal shank and located between said upper and lower ends thereof; and (c) a transition shank having an end articulated with and pivotally mounted to said hinge defining means on said terminal shank between said upper and lower ends of said terminal shank and at said other of said sides thereof and extending from said other side of said terminal shank toward the other of the floor segments such that said transition shank is swivelable relative to said terminal shank at only said other side and between said upper and lower ends thereof within an angular range providing a transition between the bordering floor segments of different levels.

2. The device of claim 1 wherein said terminal shank extends upwardly approximately at a right angle to said securement shank.

3. The device of claim 1 wherein said hinge defining means on said terminal shank is a hinge pin attached thereto and extending outwardly from said other side of said terminal shank.

4. The device of claim 3 wherein said transition shank has a hinging seat formed thereon complementary in shape to said hinge pin of said terminal shank so as to pivotally connect said transition shank to said terminal shank for undergoing swivelable movement relative thereto.

5. The device of claim 1 wherein said terminal shank has an annular recess formed on said other side thereof facing toward the other floor segment.

6. The device of claim 1 wherein said annular recess has a semi-cylindrical shape.

7. The device of claim 5 wherein said hinge defining means on said terminal shank is a hinge pin attached to said terminal shank within said annular recess thereon and extending outwardly from said other side of said terminal shank.

8. The device of claim 7 wherein said hinge pin has a cylindrical shape.

9. The device of claim 7 wherein said transition shank has a hinging seat formed thereon and being complementary in shape to said annular recess and hinge pin of said terminal shank so as to pivotally connect said transition shank to said terminal shank for undergoing swivelable movement relative thereto.

10. The device of claim 9 wherein said annular recess, hinge pin and hinging seat have complementary cylindrical configurations.

11. Bridge device for providing a transition between two bordering floor segments of different levels, said device comprising:

(a) a securement shank positionable under one of two bordering floor segments separated by a space and of different levels;

(b) a terminal shank having spaced upper and lower ends and being attached at said lower end to said securement shank and extending upwardly therefrom and positionable in the space between the floor segments, said terminal shank also having opposite sides extending between said upper and lower ends thereof, one of said sides disposed adjacent to and facing toward the one floor segment, the other of said sides facing toward the other of the floor segments; and (c) a transition shank having an end articulated with and pivotally mounted to said terminal shank between said upper and lower ends thereof at said other of said sides thereof and extending from said other side of said terminal shank toward the other of the floor segments such that said transition shank is swivelable relative to said terminal shank within an angular range providing a transition between the bordering floor segments of different levels, said transition shank having a top portion that nearly abuts and is generally flush with said upper end of said terminal shank so as to avoid formation of a step between said transition shank and terminal shank.

12. Bridge device for providing a transition between two bordering floor segments of different levels, said device comprising:

(a) a securement shank positionable under one of two bordering floor segments separated by a space and of different levels;

(b) a terminal shank having spaced upper and lower ends and being attached at said lower end to said securement shank and extending upwardly therefrom and positionable in the space between the floor segments, said terminal shank also having opposite sides extending between said upper and lower ends thereof, one of said sides disposed adjacent to and facing toward the one floor segment, the other of said sides facing toward the other of the floor segments, said upper end of said terminal shank having an extension thereon directed toward an edge of the one floor segment to be protected by said terminal shank; and (c) a transition shank having an end articulated with and pivotally mounted to said terminal shank between said upper and lower ends thereof at said other of said sides thereof and extending from said other side of said terminal shank toward the other of the floor segments such that said transition shank is swivelable relative to said terminal shank within an angular range providing a transition between the bordering floor segments of different levels.

13. Bridge device for providing a transition between two bordering floor segments of different levels, said device comprising:

(a) a securement shank positionable under one of two bordering floor segments separated by a space and of different levels;

(b) a terminal shank having spaced upper and lower ends and being attached at said lower end to said securement shank and extending upwardly therefrom and positionable in the space between the floor segments, said terminal shank also having opposite sides extending between said upper and lower ends thereof, one of said sides disposed adjacent to and facing toward the one floor segment, the other of said sides facing toward the other of the floor segments, said terminal shank also having a spacing element thereon spaced between said upper and lower ends thereof and extending from said one side thereof so as to position said terminal shank in a spaced relation away from the one floor segment and thereby provide an open joint between the bordering edge of the one floor segment and said terminal shank that can be filled with a material in order to maintain the position of said terminal shank relative to the one floor segment; and (c) a transition shank having an end articulated with and pivotally mounted to said terminal shank between said upper and lower ends thereof at said other of said sides thereof and extending from said other side of said terminal shank toward the other of the floor segments such that said transition shank is swivelable relative to said terminal shank within an angular range providing a transition between the bordering floor segments of different levels.

14. The device of claim 13 wherein said spacing element is a flange extending from said one side of said terminal shank.

* * * * *